US010840638B2

(12) United States Patent
M K et al.

(10) Patent No.: US 10,840,638 B2
(45) Date of Patent: Nov. 17, 2020

(54) CONNECTOR HOUSING AND CONNECTOR

(71) Applicants: Tyco Electronics (Shanghai) Co. Ltd., Shanghai (CN); TE Connectivity India Private Limited, Bangalore (IN); Tyco Electronics AMP Italia S.R.L., Turin (IT)

(72) Inventors: Dhanesh M K, Kannur (IN); Hongbo Zhang, Shanghai (CN); Riccardo Francesco Robone, Turin (IT)

(73) Assignees: Tyco Electronics (Shanghai) Co. Ltd., Shanghai (CN); TE Connectivity India Private Limited, Bangalore (IN); Tyco Electronics AMP Italia S.r.l., Turin (IT)

( * ) Notice: Subject to any disclaimer, the term of this patent is extended or adjusted under 35 U.S.C. 154(b) by 0 days.

(21) Appl. No.: 16/249,297

(22) Filed: Jan. 16, 2019

(65) Prior Publication Data

US 2019/0221967 A1 Jul. 18, 2019

(30) Foreign Application Priority Data

Jan. 16, 2018 (CN) ..... 2018 1 0040587
Jan. 16, 2018 (CN) ..... 2018 2 0067573 U

(51) Int. Cl.
*H01R 13/62* (2006.01)
*H01R 13/627* (2006.01)
*H01R 13/635* (2006.01)

(52) U.S. Cl.
CPC ..... *H01R 13/6273* (2013.01); *H01R 13/6272* (2013.01); *H01R 13/635* (2013.01)

(58) Field of Classification Search
CPC ..... H01R 13/6272; H01R 13/6271; H01R 13/6273; H01R 13/6275
See application file for complete search history.

(56) References Cited

U.S. PATENT DOCUMENTS 3,569,909 A * 3/1971 Garver ..... H01R 13/6273 439/353
4,602,839 A * 7/1986 Winger ..... H01R 13/6272 439/358
6,364,718 B1 4/2002 Polgar et al.
8,512,062 B1 8/2013 Zhou
9,368,909 B2 * 6/2016 Yagi ..... H01R 13/6272
(Continued)

OTHER PUBLICATIONS

Extended European Search Report, European Patent Application No. 19151840.6, dated Sep. 5, 2019, 9 pages.

*Primary Examiner* — Ross N Gushi
(74) *Attorney, Agent, or Firm* — Barley Snyder

(57) ABSTRACT

A connector housing adapted to receive a contact comprises a first latch disposed on a top surface of the housing and having a first pressing part and a first extension portion formed on the first pressing part and a second latch disposed on the top surface of the housing and having a second pressing part and a second extension portion formed on the second pressing part. The first latch and the second latch are disposed side by side on the top surface and are adapted to lock to a case of a mating connector. The first latch and the second latch are unlocked by pressing down the first pressing part and the second pressing part. The first extension portion and the second extension portion are disposed adjacent to each other.

22 Claims, 7 Drawing Sheets

(56) References Cited

U.S. PATENT DOCUMENTS

| | | | | |
|---|---|---|---|---|
| 2009/0053937 | A1* | 2/2009 | Tsou | H01R 13/514<br>439/638 |
| 2009/0156046 | A1* | 6/2009 | Chen | H01R 13/6272<br>439/345 |
| 2013/0045638 | A1 | 2/2013 | Gui et al. | |
| 2018/0337490 | A1* | 11/2018 | Choi | H01R 13/6273 |

* cited by examiner

CONNECTOR HOUSING AND CONNECTOR

CROSS-REFERENCE TO RELATED APPLICATION

This application claims the benefit of the filing date under 35 U.S.C. § 119(a)-(d) of Chinese Patent Application No. 201810040587.7, filed on Jan. 16, 2018, and Chinese Patent Application No. 201820067573.X, filed on Jan. 16, 2018.

FIELD OF THE INVENTION

The present invention relates to a connector housing and, more particularly, to a connector housing having a latch.

BACKGROUND

A connector generally comprises a housing and a contact received in the housing. A latch is disposed on the housing. When the connector is mated with a mating connector, a case of the mating connector is locked to the housing of the connector by the latch. An operator must press down a pressing part of the latch to unlock the latch before removing the connector from the mating connector.

The pressing part of the latch generally has a very small size in a width direction of the housing, and therefore, it is difficult for the operator to touch the pressing part of the latch with a finger as the operator cannot see the latch, which increases the difficulty of unlocking the latch.

Moreover, two latches are sometimes required to be provided side by side on the housing of the connector. A distance between the pressing parts of the two latches is larger than a width of a single finger of the operator. Thereby, it is difficult for the operator to press down the pressing parts of the two latches at the same time with a single finger, which also increases the difficulty of unlocking the latches.

SUMMARY

A connector housing adapted to receive a contact comprises a first latch disposed on a top surface of the housing and having a first pressing part and a first extension portion formed on the first pressing part and a second latch disposed on the top surface of the housing and having a second pressing part and a second extension portion formed on the second pressing part. The first latch and the second latch are disposed side by side on the top surface and are adapted to lock to a case of a mating connector. The first latch and the second latch are unlocked by pressing down the first pressing part and the second pressing part. The first extension portion and the second extension portion are disposed adjacent to each other.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
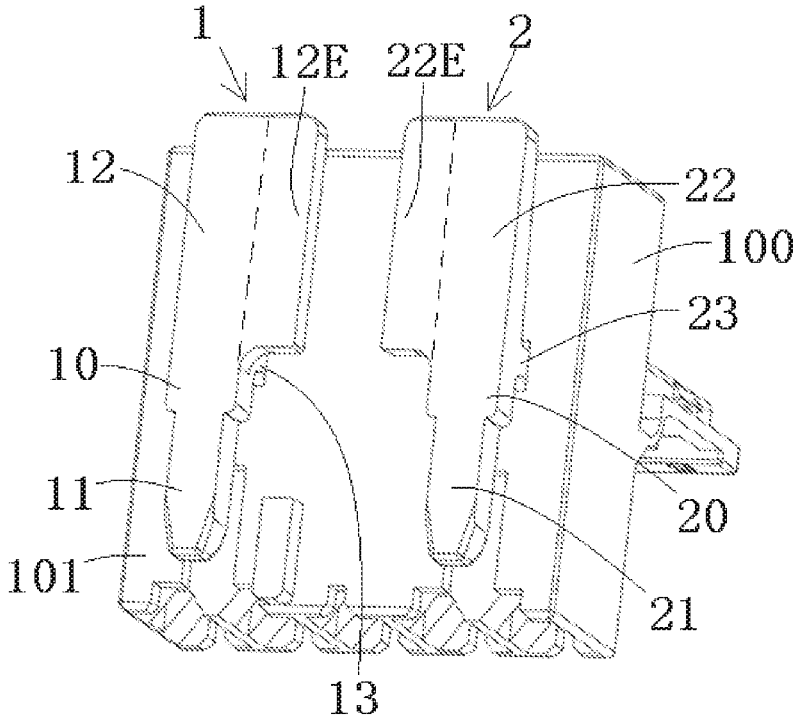
FIG. 1 is a perspective view of a connector according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
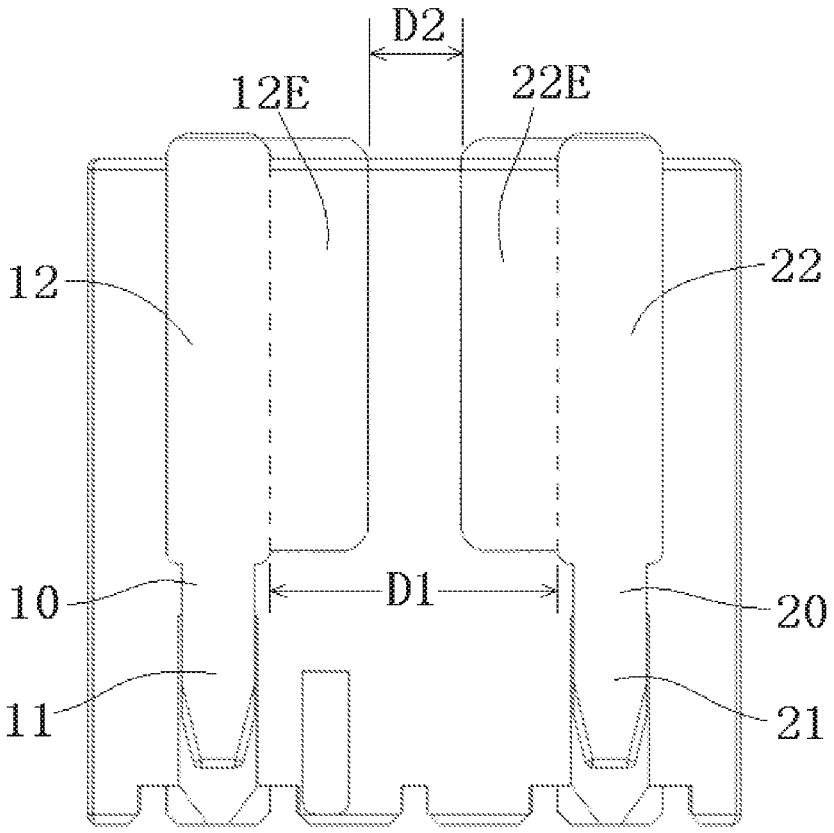
FIG. 2 is a top view of the connector of FIG. 1.

A connector according to an embodiment, as shown in FIGS. 1 and 2, comprises a housing 100 and a contact received in the housing 100. A first latch 1 and a second latch 2 for locking to a case 200 of a mating connector shown in FIGS. 4 and 5 are disposed side by side on a top surface 101 of the housing 100.

Figure 3:
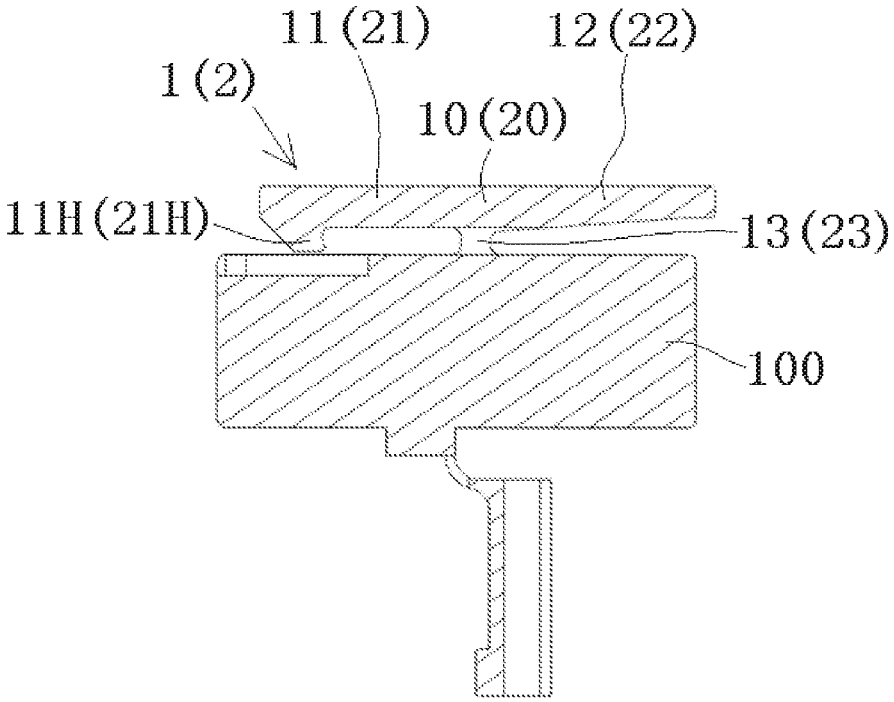
FIG. 3 is a sectional side view of the connector of FIG. 1.
Figure 4:
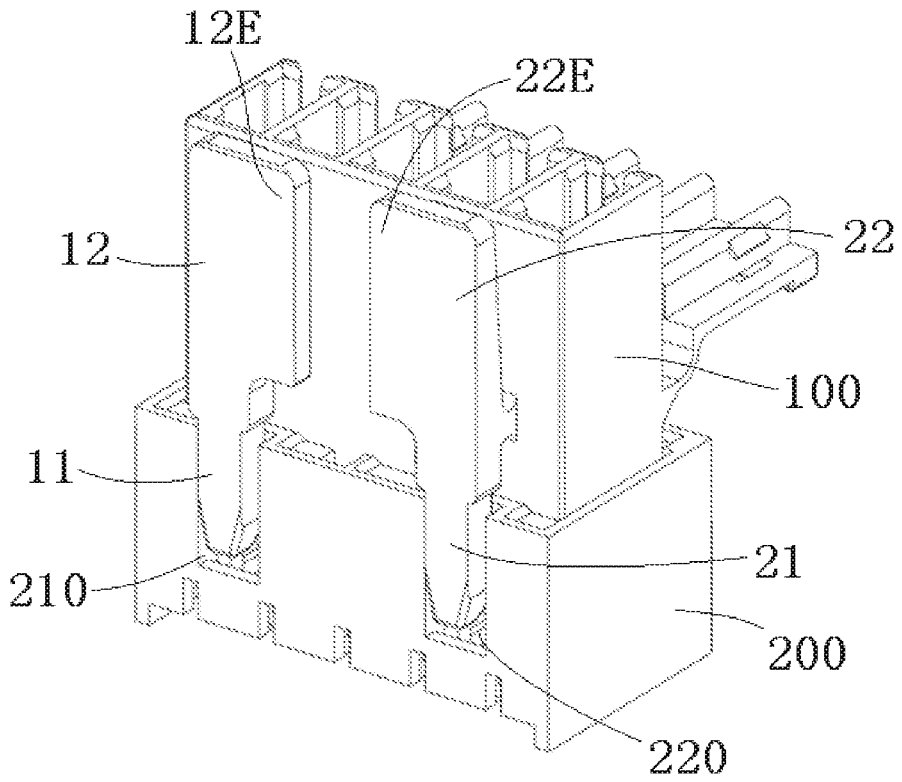
FIG. 4 is a perspective view of the connector of FIG. 1 mated with a mating connector.
Figure 5:
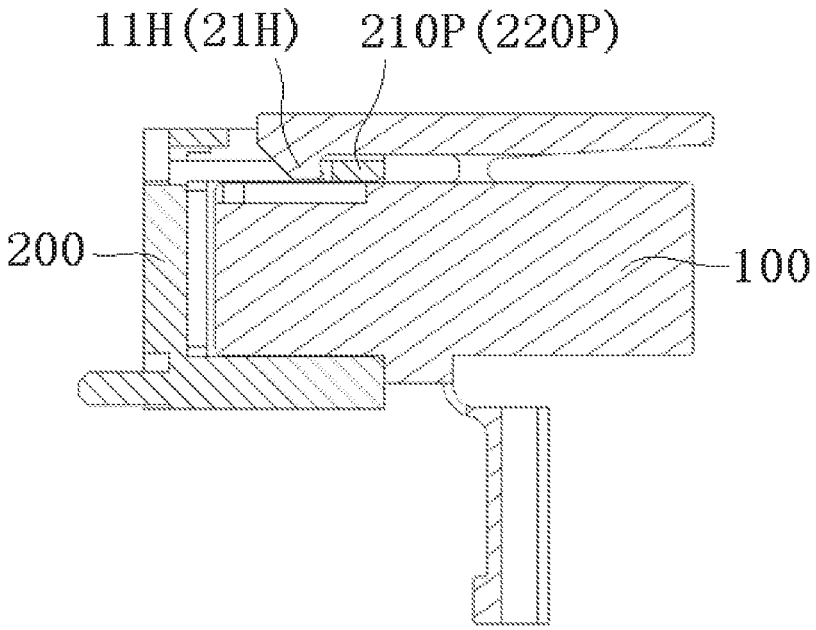
FIG. 5 is a sectional side view of the connector of FIG. 1 mated with the mating connector.

As shown in FIGS. 3-5, in an embodiment, the first latch 1 includes a first pressing part 12 and the second latch 2 includes a second pressing part 22. The first latch 1 and the second latch 2 may be unlocked by pressing down the first pressing part 12 and the second pressing part 22.

As shown in FIGS. 1 and 2, in an embodiment, the first latch 1 and the second latch 2 are arranged on a left side and a right side of the top surface 101 of the housing 100, respectively. A distance D1 between the first pressing part 12 and the second pressing part 22 is larger than a width of a finger of an operator. The operator thereby cannot press the first pressing part 12 and the second pressing part 22 at the same time with a single finger.

In order to press the first pressing part 12 and the second pressing part 22 at the same time with a single finger, in an embodiment shown in FIGS. 1-5, a first extension portion 12E and a second extension portion 22E adjacent to each other are formed on the first pressing part 12 and the second pressing part 22, respectively. As clearly shown in FIG. 2, the distance D1 between the first pressing part 12 and the second pressing part 22 in the width direction of the housing 100 is larger than the width of the single finger of the operator, but a distance D2 between the first extension portion 12E and the second extension portion 22E in the width direction of the housing 100 is less than the width of the single finger of the operator. In this way, the operator may press the first extension portion 12E and the second extension portion 22E at the same time with a single finger. The first latch 1 and the second latch 2 may be unlocked at the same time by pressing down the first extension portion 12E and the second extension portion 22E with a single finger.

In an embodiment, as shown in FIG. 2, the distance D1 between the first pressing part 12 and the second pressing part 22 is larger than 30 mm and the distance D2 between the first extension portion 12E and the second extension portion 22E is less than 30 mm. Because the width of an adult's thumb is usually about 30 mm, the operator may press the first extension portion 12E and the second extension portion 22E at the same time with the thumb. In another embodiment, the distance D1 between the first pressing part 12 and the second pressing part 22 is larger than 40 mm and the distance D2 between the first extension portion 12E and the second extension portion 22E is less than 20 mm.

As shown in FIGS. 1-5, the first latch 1 includes a first arm 10 and a first elastic support portion 13. The first arm 10 horizontally extends in a longitudinal direction of the housing 100. The first elastic support portion 13 is connected between the first arm 10 and the housing 100 to support the first arm 10 on the housing 100. A front part of the first arm 10 before the first elastic support portion 13 is used as a first latching part 11 and a rear part of the first arm 10 behind the first elastic support portion 13 is used as the first pressing part 12. A first hook 11H for locking a protrusion 210P formed on the case 200 of the mating connector is formed on a front end of the first latching part 11.

As shown in FIGS. 1-5, the second latch 2 includes a second arm 20 and a second elastic support portion 23. The second arm 20 horizontally extends in the longitudinal direction of the housing 100. The second elastic support portion 23 is connected between the second arm 20 and the housing 100 to support the second arm 20 on the housing 100. A front part of the second arm 20 before the second elastic support portion 23 is used as a second latching part 21 and a rear part of the second arm 20 behind the second elastic support portion 23 is used as the second pressing part 21. A second hook 21H for locking a protrusion 220P formed on the case 200 of the mating connector is formed on a front end of the second latching part 21.

As shown in FIGS. 3-5, a first slot 210 and a second slot 220 for mating with the first latching part 11 and the second latching part 21, respectively, are formed in the case 200 of the mating connector. The first protrusion 210P and the second protrusion 220P are formed on bottom surfaces of the first slot 210 and the second slot 220, respectively. As shown in FIGS. 4-5, when the connector and the mating connector are mated with each other, the first latching part 11 and the second latching part 21 are inserted into the first slot 210 and the second slot 220 and respectively locked to the first protrusion 210P and the second protrusion 220P.

Figure 6:
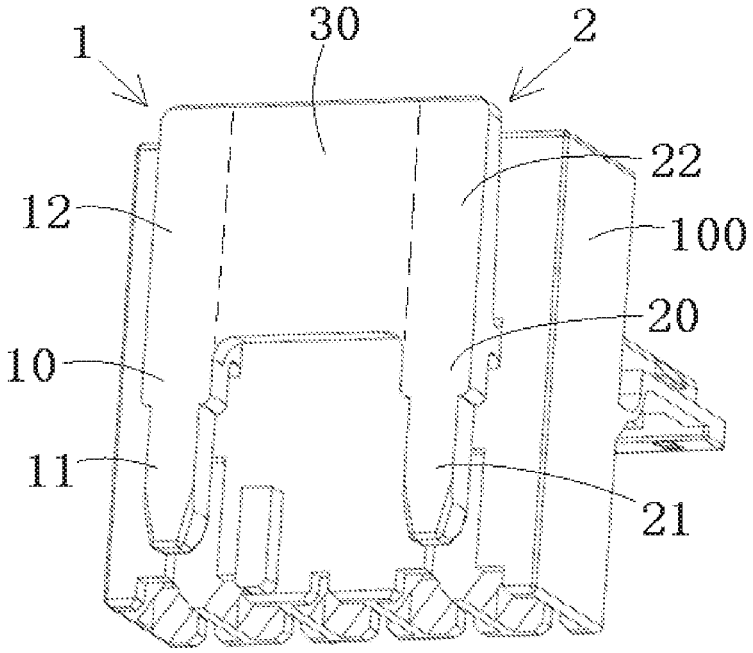
FIG. 6 is a perspective view of a connector according to another embodiment.

A connector according to another embodiment is shown in FIG. 6. The connector includes a housing 100 and a contact received in the housing 100. A first latch 1 and a second latch 2 for locking a case 200 of a mating connector are provided side by side on a top surface 101 of the housing 100. The first latch 1 includes a first pressing part 12 and the second latch 2 includes a second pressing part 22. The first latch 1 and the second latch 2 may be unlocked by pressing down the first pressing part 12 and the second pressing part 22. As shown in FIG. 6, the first pressing part 12 and the second pressing part 22 are connected by a connection portion 30, so that the first latch 1 and the second latch 2 are capable of being unlocked at the same time by pressing down the connection portion 30 with a single finger of an operator.

Figure 7:
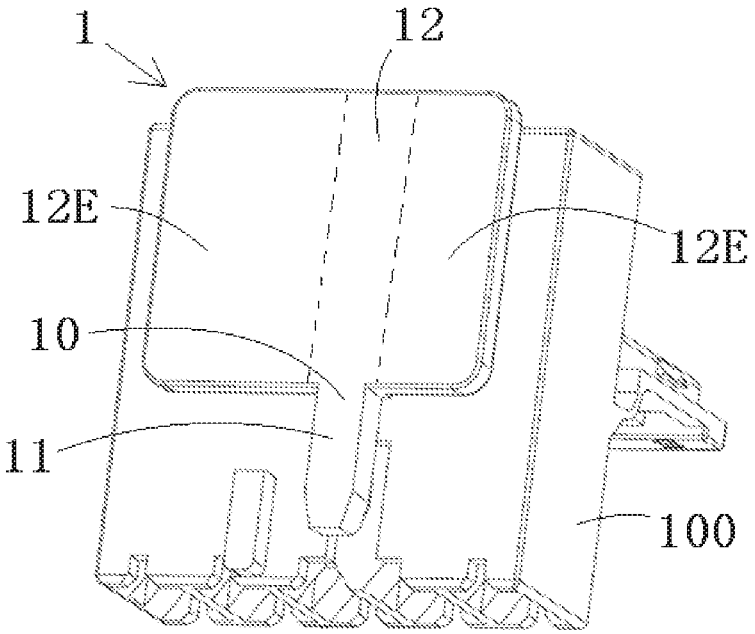
FIG. 7 is a perspective view of a connector according to another embodiment.

A connector according to another embodiment is shown in FIG. 7. The connector includes a housing 100 and a contact received in the housing 100. A single latch 1 for locking a case 200 of a mating connector is disposed on a top surface 101 of the housing 100. The latch 1 includes a pressing part 12 and may be unlocked by pressing down the pressing part 12. As shown in FIG. 7, an extension portion 12E extending in a width direction of the housing 100 is formed on one side or both sides of the pressing part 12, so that the latch 1 is capable of being unlocked by pressing down the extension portion 12E with a single finger of an operator.

What is claimed is:

1. A connector housing adapted to receive a contact, comprising:

a first latch disposed on a top surface of the housing and having a first latching part, a first pressing part, and a first extension portion formed on the first pressing part, the first extension portion has a surface that is planar with a surface of the first pressing part and a surface of the first latching part; and a second latch disposed on the top surface of the housing and having a second pressing part and a second extension portion formed on the second pressing part, the first latch and the second latch are disposed side by side on the top surface and are adapted to lock to a case of a mating connector, the first latch and the second latch are unlocked by pressing down the first pressing part and the second pressing part, the first extension portion and the second extension portion are disposed adjacent to each other.

2. The connector housing of claim 1, wherein the first latch and the second latch are adapted to be unlocked by simultaneously pressing down the first extension portion and the second extension portion with a single finger of an operator.

3. The connector housing of claim 2, wherein a distance between the first pressing part and the second pressing part is larger than a width of the single finger of the operator.

4. The connector housing of claim 3, wherein a distance between the first extension portion and the second extension portion is less than the width of the single finger of the operator.

5. The connector housing of claim 4, wherein the distance between the first pressing part and the second pressing part is larger than 30 mm and the distance between the first extension portion and the second extension portion is less than 30 mm.

6. The connector housing of claim 5, wherein the distance between the first pressing part and the second pressing part is larger than 40 mm and the distance between the first extension portion and the second extension portion is less than 20 mm.

7. The connector housing of claim 2, wherein the first latch is disposed on a left side of the top surface of the housing and the second latch is disposed on a right side of the top surface of the housing.

8. The connector housing of claim 1, wherein the first latch includes a first arm extending horizontally in a longitudinal direction of the housing.

9. The connector housing of claim 8, wherein the first latch includes a first elastic support portion connected between the first arm and the housing and supporting the first arm on the housing.

10. The connector housing of claim 9, wherein a front part of the first arm disposed in front of the first elastic support portion in the longitudinal direction is the first latching part and a rear part of the first arm disposed behind the first elastic support portion in the longitudinal direction is the first pressing part.

11. The connector housing of claim 10, wherein a front end of the first latching part has a first hook adapted to lock to a first protrusion formed on the case of the mating connector.

12. The connector housing of claim 11, wherein the second latch includes a second arm extending horizontally in the longitudinal direction of the housing.

13. The connector housing of claim 12, wherein the second latch includes a second elastic support portion connected between the second arm and the housing and supporting the second arm on the housing.

14. The connector housing of claim 13, wherein a front part of the second arm disposed in front of the second elastic support portion in the longitudinal direction is a second latching part and a rear part of the second arm disposed behind the second elastic support portion in the longitudinal direction is the second pressing part.

15. The connector housing of claim 14, wherein a front end of the second latching part has a second hook adapted to lock to a second protrusion formed on the case of the mating connector.

16. The connector housing of claim 15, wherein the first latching part mates with a first slot of the case of the mating connector and the second latching part mates with a second slot of the case of the mating connector.

17. The connector housing of claim 16, wherein the first protrusion is formed on a bottom surface of the first slot and the second protrusion is formed on a bottom surface of the second slot.

18. The connector housing of claim 1, wherein the second latch has a second latching part, the second extension portion has a surface that is planar with a surface of the second pressing part and a surface of the second latching part.

19. The connector housing of claim 18, wherein the second extension portion is planar with the first extension portion.

20. The connector housing of claim 1, wherein the first extension portion extends only from a side of the first pressing part facing the second pressing part and the second extension portion extends only from a side of the second pressing part facing the first pressing part.

21. A connector, comprising:

a contact; and a connector housing receiving the contact, the connector housing including a first latch disposed on a top surface of the housing and having a first latching part and a first pressing part and a second latch disposed on the top surface of the housing and having a second pressing part, the first latch and the second latch are disposed side by side on the top surface and are adapted to lock to a case of a mating connector, the first latch and the second latch are unlocked by pressing down the first pressing part and the second pressing part, the first pressing part and the second pressing part are connected by a connection portion and the first latch and the second latch are adapted to be simultaneously unlocked by pressing down the connection portion with a single finger of an operator, the connection portion has a surface that is planar with a surface of the first pressing part and a surface of the first latching part.

22. A connector, comprising:

a contact; and a connector housing receiving the contact and including a single latch disposed on a top surface of the housing in a position offset from a center of the housing in a first width direction transverse to a plug-in direction of the housing, the latch is adapted to lock to a case of a mating connector and is unlocked by pressing down a pressing part of the latch, an extension portion extends from the pressing part in the first width direction of the housing a first distance, and extends from the pressing part in a second width direction opposite the first width direction a second distance, greater than the first distance, the extension portion has a surface that is planar with a surface of the pressing part and a surface of a latching part of the latch such that a top surface of the latch defines a uniform and uninterrupted planar surface between its edges, the latch is adapted to be unlocked by pressing down the extension portion with a single finger of an operator.

* * * * *